US006846392B1

(12) United States Patent
Stockbower

(10) Patent No.: US 6,846,392 B1
(45) Date of Patent: Jan. 25, 2005

(54) HYDROPHOBIC AND HYDROPHILIC MEMBRANES TO VENT TRAPPED GASES IN A PLATING CELL

(75) Inventor: David W. Stockbower, Burlington, MA (US)

(73) Assignee: Mykrolis Corporation, Bedford, MA (US)

( * ) Notice: Subject to any disclaimer, the term of this patent is extended or adjusted under 35 U.S.C. 154(b) by 430 days.

(21) Appl. No.: 10/009,744

(22) PCT Filed: May 31, 2000

(86) PCT No.: PCT/US00/14976

§ 371 (c)(1),
(2), (4) Date: Mar. 8, 2002

(87) PCT Pub. No.: WO00/75402

PCT Pub. Date: Dec. 14, 2000

Related U.S. Application Data

(60) Provisional application No. 60/137,558, filed on Jun. 4, 1999.

(51) Int. Cl.[7] ..... C25B 9/00

(52) U.S. Cl. ..... 204/266; 204/270; 204/278; 204/282; 204/283; 204/292; 205/88; 205/148; 205/338; 205/350

(58) Field of Search ..... 204/266, 270, 204/278, 282, 283, 292; 205/88, 148, 338, 350

(56) References Cited

U.S. PATENT DOCUMENTS

| | | | | |
|---|---|---|---|---|
| 4,075,069 | A | 2/1978 | Shinohara et al. | 204/106 |
| 4,201,653 | A | 5/1980 | O'Neill et al. | 204/263 |
| 4,522,695 | A | 6/1985 | Neefe | 204/266 |
| 5,112,465 | A | 5/1992 | Danielson | 204/278 |
| 5,616,246 | A | 4/1997 | Gagnon et al. | 210/490 |
| 6,258,220 | B1 * | 7/2001 | Dordi et al. | 204/198 |

* cited by examiner

*Primary Examiner*—Bruce F. Bell
(74) *Attorney, Agent, or Firm*—Nields & Lemack

(57) ABSTRACT

A plating tool cell anode for venting unwanted gases from a fluid plating solution. In a first embodiment, the solution is introduced into a chamber, defined by the plating tool cell (10), by fluid inlet (12) and contacts the anode (50). The fluid encounters a hydrophobic membrane (14) and a hydrophilic membrane (15) spaced from the hydrophobic membrane. A driving force, such as a vacuum, is applied to the gap (16) between the membranes to remove unwanted gases therein. In a second embodiment, a single membrane is used that is both hydrophobic and hydrophilic. Preferably, the hydrophobic portion of the membrane is located at or near the perimeter of the chamber and gas to be vented is directed toward the hydrophobic portion(s).

10 Claims, 4 Drawing Sheets

HYDROPHOBIC AND HYDROPHILIC MEMBRANES TO VENT TRAPPED GASES IN A PLATING CELL

This application claims the benefit of Provisional application Ser. No. 60/137,558, filed Jun. 4, 1999.

BACKGROUND OF THE INVENTION

In semiconductor manufacturing, a plating tool uses a negatively charged anode (usually a copper anode) to plate a positively charged (cathode) silicon wafer. The anode provides a source of replenishing metal ions. At the cathode, the metal ions are reduced to metal and deposited on the cathode surface. Sulfuric acid and a plating solution flows through a chamber around the anode and is used to dissolve a metal (copper) plate. As fluid flows past the anode, it becomes enriched with metal ions.

During the chemical reaction that dissolves the metal (e.g., copper), hydrogen gas is liberated. In addition, entrapped gases are generally present during start-up. These gases must be vented so that they do not effect the electrical field or the wafer plating uniformity. Indeed, a separate upstream degasser removes most dissolved air from the main fluid flow path. The generated hydrogen gas, if not removed, becomes entrapped in the plating solution as bubbles or microbubbles and may interfere with the plating operation.

It therefore would be desirable to provide a means for venting hydrogen gas and any other trapped gases out of the plating solution before the solution reaches the wafer.

SUMMARY OF THE INVENTION

The problems of the prior art have been overcome by the present invention, which provides a plating anode cup filter design that vents unwanted gases from the plating solution before they exit the cell and reach the wafer. More specifically, in a first embodiment of the present invention, in the chamber where the fluid flows into the plating tool cell and contacts the anode, it encounters a hydrophobic membrane and a hydrophilic membrane spaced from the hydrophobic membrane. A driving force such as a vacuum applied in the space between the membranes removes unwanted gases therein.

In a second embodiment of the present invention, a single membrane is used that is both hydrophobic and hydrophilic. Preferably the hydrophobic portion of the membrane is located at or near the perimeter of the fluid chamber in the plating tool cell, and gas to be vented is directed toward the hydrophobic portion(s).

DETAILED DESCRIPTION OF THE INVENTION

Figure 1:
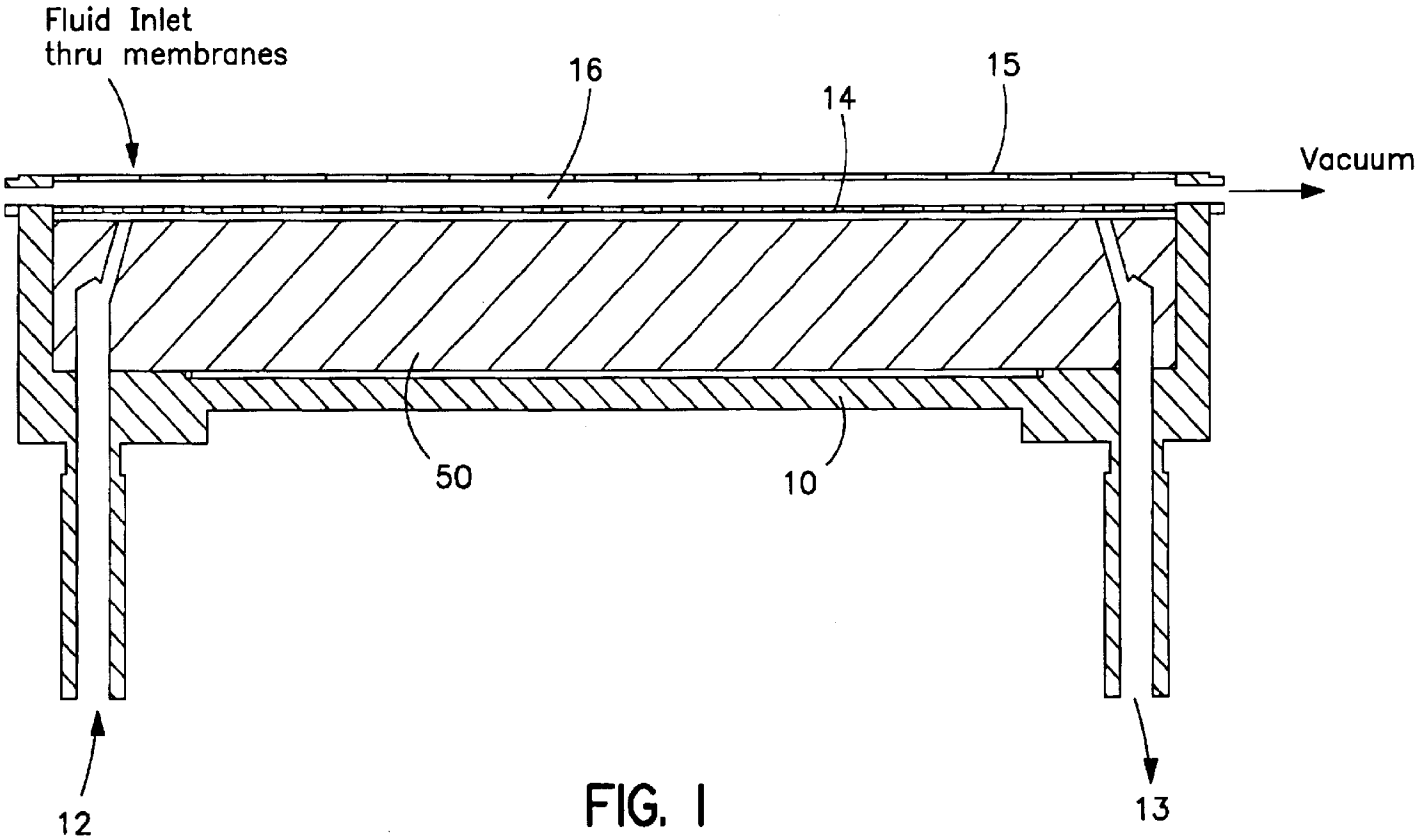
FIG. 1 is a cross-sectional view of the anode holder in accordance with the present invention.

Turning now to FIG. 1, there is shown an anode for use in semiconductor manufacturing. A plating tool cell 10 is the housing for the anode 50, which is preferably a copper anode, and includes one or more fluid inlets 12. Thus, the plating tool cell 10 serves as an anode holder and as a means for fluid distribution to the substrate being plated, such as a wafer (not shown) which is typically rotating for uniform plating. Preferably the plating tool cell 10 is made of plastic, and includes an optional fluid inlet 12 and a fluid outlet 13.

Figure 2:
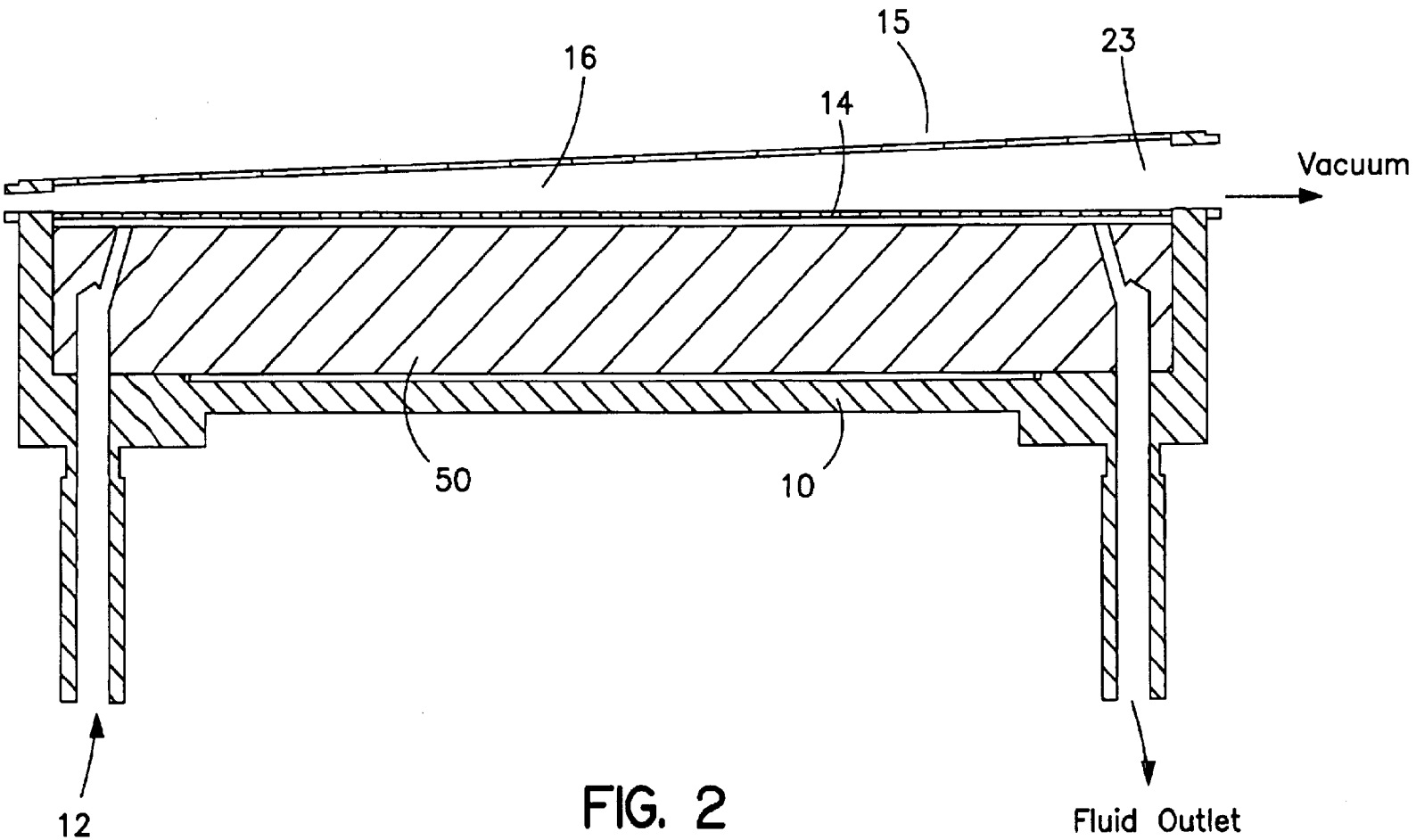
FIG. 2 is a cross-sectional view of the anode holder in accordance with another embodiment of the present invention.

A fluid plating solution or ion source, such as copper sulfate, is introduced into a chamber defined by the plating tool cell 10 through optional fluid inlet 12, and contacts the anode 5O. The resulting reaction between the plating solution and the metal anode generates hydrogen gas. In the embodiment shown, situated in the fluid path is a hydrophobic membrane 14. The hydrophobicity of the membrane 14 inhibits or prevents passage of the fluid. However, the porosity of the hydrophobic membrane 14 is such that gases, generally air and hydrogen, entrapped in the fluid are able to pass through the hydrophobic membrane 14 easily. A second membrane 15 is positioned downstream of the first membrane (in the direction away from the anode 50). The second membrane 15 is spaced from the first membrane 14, and is hydrophilic. Once the hydrophilic membrane 15 is wetted, it does not allow the passage of gases through it. Accordingly, most or all of the gases remain in the gap 16 between the two membranes. The gap 16 can be filled with a open mesh type separation material, and may be 1/16 to 1/4 inch wide, on average. A driving force such as a vacuum source in communication with the gap 16 with suitable plumbing draws off the gases, thereby preventing them from contacting the wafer and causing defects. Alternatively, high velocity air can be used to create a vacuum by the venturi effect to draw off the gases. FIG. 2 shows another embodiment where the gases are vented in gap 16 by creating a high spot 23 in the gap 16 mechanically. The high spot 23 is a portion of the gap 16 that is wider, from membrane 14 to membrane 15, than the total average width of the gap 16. The air tends to collect in the high spot 23 and vent naturally, or can be assisted with a vacuum or high velocity air pressure. The high spot 23 also can be created by bowing the membrane with external fluid pressure, leaving high spots during processing.

Figure 3:
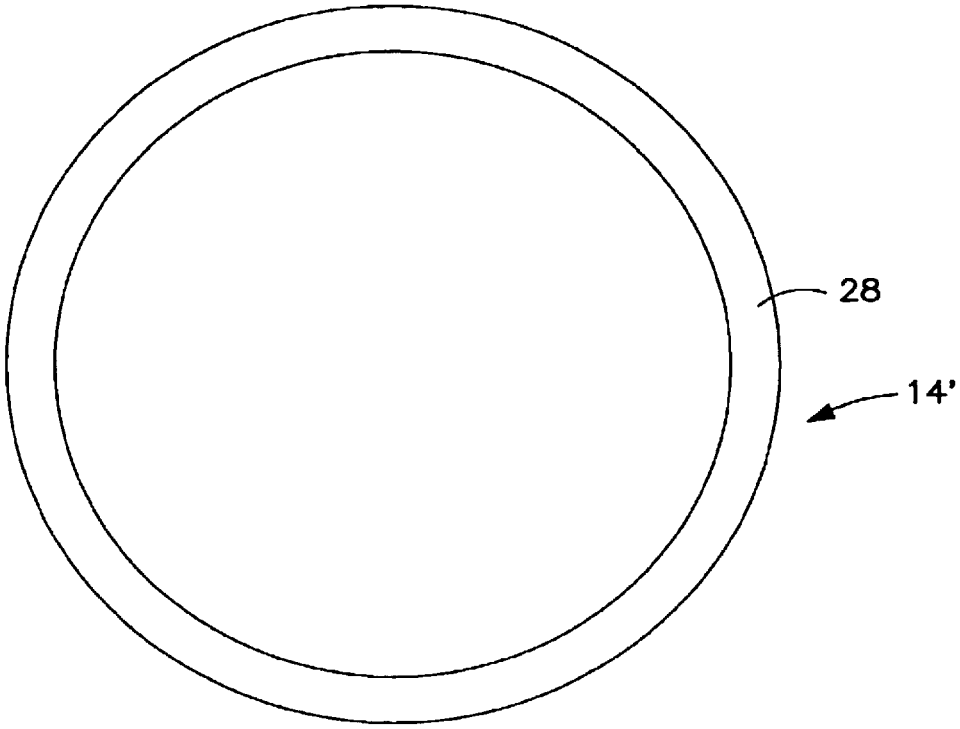
FIG. 3 is a top view of a membrane having hydrophilic and a hydrophobic portions in accordance with one embodiment of the present invention.
Figure 4:
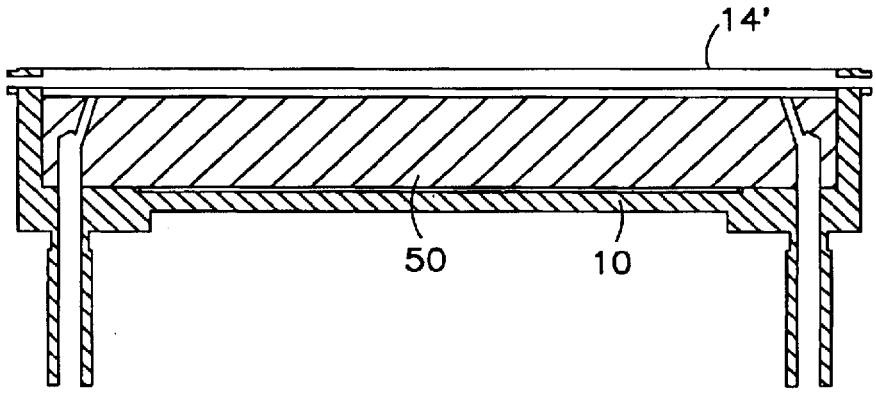
FIG. 4 is a cross-sectional view of an anode holder using the membrane of FIG. 3.

FIG. 3 illustrates another embodiment of the present invention. In this embodiment, the membrane 14' is patterned such that only a portion 28 thereof is hydrophobic. Conventional techniques to render portions of the membrane hydrophobic well known to those skilled in the art can be used. Preferably, the hydrophobic portion(s) are located at or near the perimeter of the cell 10, and the fluid flow is directed towards the perimeter, as shown in FIG. 4.

Figure 5:
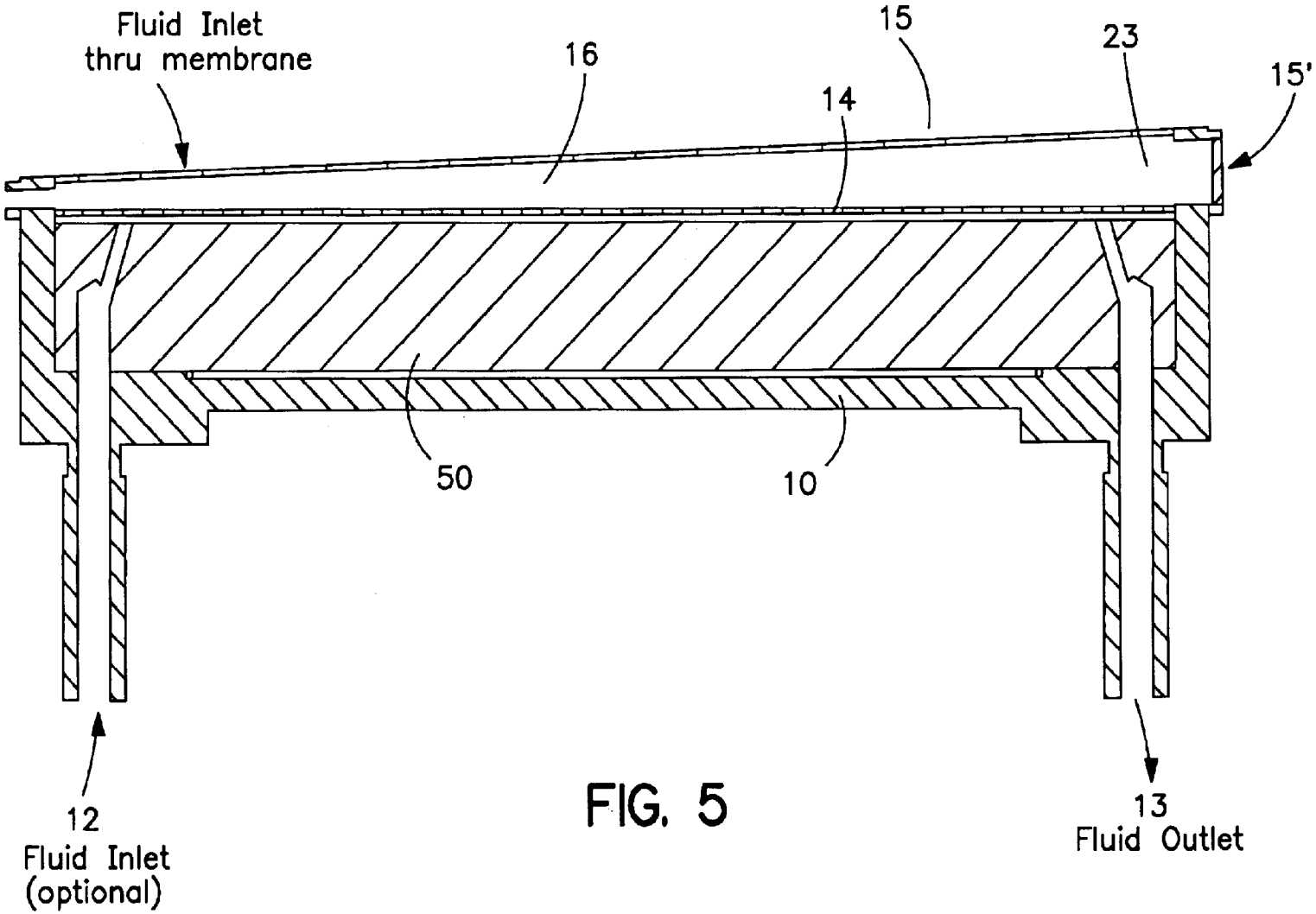
FIG. 5 is a cross-sectional view of still another embodiment of the present invention.

FIG. 5 illustrates another embodiment of the present invention, where a high spot 23 is created and a small hydrophobic membrane patch 15' is used in a vertical orientation. The hydrophobic membrane 15 is optional, and a bowed hydrophilic membrane 14 is positioned to create a high spot 23 as in the embodiment of FIG. 2. The air trapped in gap 16 vents naturally through hydrophobic patch 15' without the use of an external driving force such as a vacuum.

The removal of bubbles from the plating solution prior to their reaching the wafer contributes to lower plating defects on the wafer.

What is claimed is:

1. An anode plating cell, comprising:

an anode;

a housing for said anode, said housing having a fluid inlet and a fluid outlet;

a hydrophobic membrane in said housing downstream of said anode;

a hydrophilic membrane in said housing downstream of and spaced from said hydrophobic membrane by a gap;

whereby gases entrapped in said fluid pass through said hydrophobic membrane into said gap and are prevented from passing through said hydrophilic membrane.

2. The anode plating cell of claim 1, further comprising a driving force for removing said entrapped gases from said gap.

3. The anode plating cell of claim 2, wherein said driving force is a vacuum.

4. The anode plating cell of claim 1, wherein said anode comprises copper.

5. An anode plating cell, comprising:

an anode;

a housing for said anode, said housing having a fluid inlet and a fluid outlet;

a membrane in said housing downstream of said anode, said membrane having a hydrophobic portion permeable to said fluid and to gases entrapped in said fluid, and a hydrophilic portion permeable to said fluid but not to said gases.

6. The anode plating cell of claim 5, further comprising a driving force for removing said entrapped gases from said housing.

7. The anode plating cell of claim 6, wherein said driving force is a vacuum.

8. The anode plating cell of claim 5, wherein said anode comprises copper.

9. A method of removing gases entrapped in a plating solution from an anode plating cell, comprising:

providing an anode in said cell;

providing a hydrophobic membrane in said cell downstream of said anode;

providing a hydrophilic membrane in said cell spaced from and downstream of said hydrophobic membrane;

circulating plating solution in said anode plating cell to contact said plating solution with said anode;

causing gases entrapped in said plating solution to pass through said hydrophobic membrane but not through said hydrophilic membrane; and removing said gases from said cell.

10. A method of removing gases entrapped in a plating solution from an anode plating cell, comprising:

providing an anode in said cell;

circulating a plating solution in said cell;

causing said plating solution to contact said anode;

providing a membrane in said cell downstream of said anode, said membrane having a hydrophobic portion permeable to said plating solution and to entrapped gases in said plating solution, and a hydrophilic portion permeable to said plating solution but not to gases entrapped in said plating solution;

causing gases entrapped in said plating solution to pass through said hydrophobic portion of said membrane but not through said hydrophilic portion; and removing said gases from said cell.

* * * * *